US006679699B2

(12) United States Patent
Yam et al.

(10) Patent No.: US 6,679,699 B2
(45) Date of Patent: Jan. 20, 2004

(54) GAS BURNER FOR A COOKER

(75) Inventors: Pierre Siu Hun Yam, Chattanooga, TN (US); Bernard Dane, Montbazon (FR)

(73) Assignee: Sourdillon (FR)

( * ) Notice: Subject to any disclaimer, the term of this patent is extended or adjusted under 35 U.S.C. 154(b) by 0 days.

(21) Appl. No.: 10/245,939

(22) Filed: Sep. 18, 2002

(65) Prior Publication Data

US 2003/0059733 A1 Mar. 27, 2003

(30) Foreign Application Priority Data

Sep. 27, 2001 (FR) ..... 01 12429

(51) Int. Cl.[7] ..... F23D 14/62; F24C 3/00

(52) U.S. Cl. ..... 431/354; 126/39 R; 126/214 D; 239/568

(58) Field of Search ..... 126/39 R, 214 D, 126/39 E, 214 R, 39 H, 39 K; 431/354, 266, 355, 284; 239/554, 556, 560, 561, 568, 601

(56) References Cited

U.S. PATENT DOCUMENTS 3,825,402 A 7/1974 Duperow et al.
5,139,417 A * 8/1992 Ghassemzadeh ..... 431/354
6,332,460 B1 * 12/2001 Paesani ..... 431/284

FOREIGN PATENT DOCUMENTS

| | | |
|---|---|---|
| DE | 3346929 | 11/1985 |
| EP | 0052934 | 6/1982 |
| FR | 1408927 | 12/1965 |
| FR | 2637051 | 3/1990 |

* cited by examiner

*Primary Examiner*—James C. Yeung
(74) *Attorney, Agent, or Firm*—Piper Rudnick LLP

(57) ABSTRACT

Gas burner for a cooker, comprising a burner head bounded by an approximately frustoconical peripheral side wall with a small cross section located at the top and including a multiplicity of slots distributed peripherally and forming flame orifices, said burner head being topped by a cover or cap; the side wall 2' has an angle of inclination α to the vertical of about 10 to 20°, and the bottom 8' of each slot 3 forming a flame orifice, which extends transversely to the side wall, has an angle of inclination β to the horizontal of about 20° to 30°.

8 Claims, 2 Drawing Sheets

GAS BURNER FOR A COOKER

FIELD OF THE INVENTION

The present invention relates to improvements to gas burners for cookers, comprising a burner head bounded by an approximately frustoconical peripheral side wall with a small cross section located at the top and including a multiplicity of slots distributed peripherally and forming flame orifices, the said burner head being topped by a cover or cap.

DESCRIPTION OF THE PRIOR ART

In FIG. 1 of the appended drawings, a conventional gas burner arrangement for a cooker has been shown highly schematically. This gas burner essentially comprises, and only as regards the invention, a burner head 1 bounded by a peripheral side wall 2. This peripheral wall 2 is slightly frustoconical with its small cross section located at the top. The peripheral wall 2 is provided with a multiplicity of slots 3, with an approximately horizontal bottom 8, these being distributed peripherally and forming orifices for flames 4. The burner head 1 is topped by a removable cover or cap 5, which closes off the top of the slots 3 and defines the flame orifices.

As regards the rest of the gas burner, this may be constructed in any appropriate manner; in particular, for extra-flat burners, the burner may, in a manner known per se, include a radial annular venturi defined by the lower face of the cap 5.

In currently known gas burners, the side wall 2 of the burner head is inclined only very slightly to the vertical, this angle of inclination typically not exceeding 1 to 3°. As a result, the flames 4, which leave their respective orifices 3 approximately perpendicular to this wall 2, have a tendency to move substantially away from the wall of the burner head and come into contact with the bottom 6 of a vessel 7 of suitable dimensions for the burner only in the vicinity of the peripheral edge of the said bottom of the vessel, as may be clearly seen in FIG. 1. Under these conditions, the bottom of the vessel is heated less in its central region: the vessel is not heated substantially homogeneously over its entire surface, while an appreciable fraction of the heat escapes to the side and is lost.

SUMMARY OF THE INVENTION

The invention aims to provide an improved arrangement which, for a given burner diameter, leads to an appreciably higher burner efficiency and a substantially increased heating rate, without it also resulting in any complication in the structure of the manufacture of the burner.

For these purposes, a gas burner as mentioned in the preamble is characterized, being designed in accordance with the invention, in that the side wall has an angle of inclination to the vertical of 10 to 20°, advantageously about 15°, and in that the bottom of each slot forming a flame orifice, which extends transversely to said side wall, has an angle of inclination to the horizontal of 20° to 30°, advantageously about 25°.

By virtue of this arrangement, the flames leave the respective orifices closer to the vertical so that they reach the bottom of the vessel in a more central region thereof and this bottom is heated more homogeneously. Correspondingly, a smaller fraction of the heat escapes to the side. In total, the heat is transmitted to the vessel and to its contents under appreciably better conditions and the overall efficiency of the burner is substantially improved.

In a standard gas burner arrangement in which the cap projects radially outwards beyond the side wall of the burner head, provision is made, in accordance with the invention, for the peripheral annular portion of the lower face of the cap, which projects radially beyond the side wall of the burner head, to be inclined by approximately 90° to 110°, preferably around 100°, and to have a stand-off with respect to the said side wall; thus, the shape given to the projecting portion of the cap is more clear of the space above the flame orifices and allows the flames to stand up better.

Again for the same purpose, and optionally in combination with the arrangements that have just been explained, provision may be made for the peripheral annular portion of the lower face of the cap, which projects radially beyond the side wall of the burner head, to have a stand-off of about 2 mm to 6 mm with respect to the bearing surface of the cap on the top of the burner head; advantageously, the stand-off is about 3 mm. Such an arrangement has the advantage of being structurally simple and easy to manufacture.

The implementation of the arrangements of the invention results in a shorter heating time, for example to bring a given volume of liquid to boiling. To be more specific, to bring a 6 liter volume of water, contained in a vessel having a diameter of 203 mm, from a temperature of 22° C. to a temperature of 98° C., a time of around 21 min is required with a burner designed in accordance with the invention, as opposed to about 25 min with a conventionally designed burner. The arrangements according to the invention therefore allow the heating time to be substantially reduced (by around 16% in the example in question) and therefore result in a corresponding saving in gas consumption.

BRIEF DESCRIPTION OF THE DRAWINGS

The invention will be more clearly understood on reading the detailed description which follows of a preferred embodiment given as an entirely non-limiting example. In this description, reference will be made to the appended drawing in which.

DETAILED DESCRIPTION OF THE INVENTION

Figure 1:
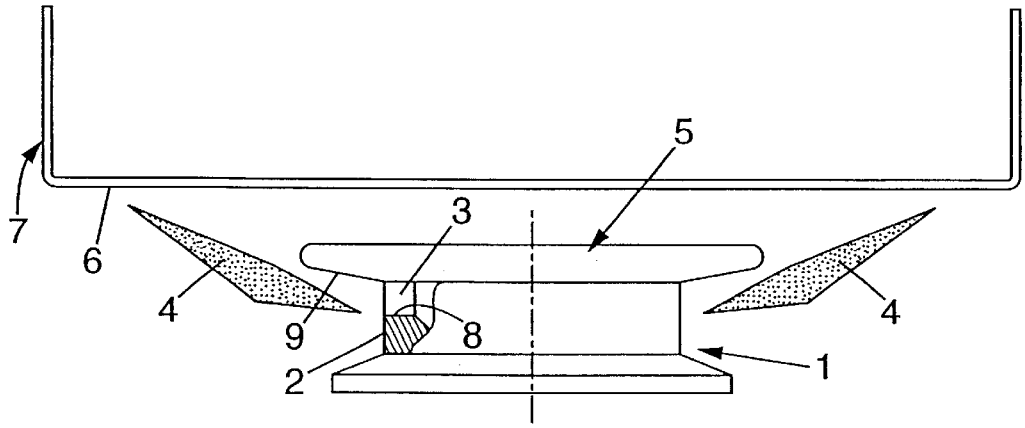
FIG. 1 PRIOR ART
FIG. 1, which is described above, illustrates a prior art gas burner arrangement for a cooker shown highly schematically.
Figure 2:
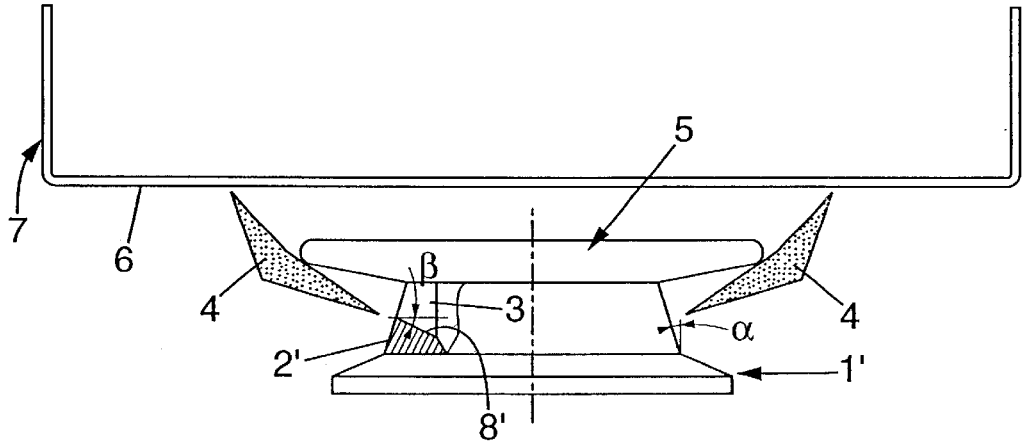
FIG. 2 illustrates schematically a burner head designed in accordance with the invention.

In FIG. 2, the gas burner 1' is represented in an identical manner to that given in FIG. 1, with the exception of the arrangements specific to the invention, and the same numerical reference numbers have been retained for denoting the members or parts that are unchanged.

In accordance with the invention, the peripheral side wall 2' has a more pronounced conicity than in the prior burners and its angle of inclination $\alpha$ to the vertical is around 10° to 20°, typically about 15°.

In addition, the bottom 8' of each slot 3 forming a flame orifice, which extends transversely to the said wall 2, has an angle of inclination $\beta$ to the horizontal which is around 20° to 30°, typically about 25°.

Under these conditions, as may be seen in FIG. 2 (in which the cap 5 remains identical, both in terms of shape and position, to that which it was in FIG. 1), the flames 4 stand up more than in the configuration of FIG. 1 and reach the bottom 6 of the vessel in a more central area of the latter. The entire bottom 6 is therefore heated more homogeneously and a smaller fraction of heat escapes to the side.

Figure 3:
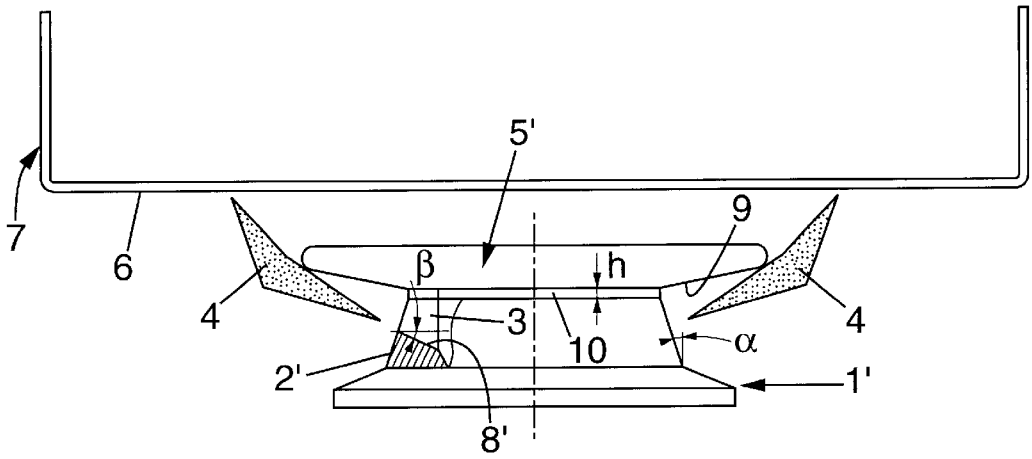
FIGS. 3 and 4 illustrate schematically two preferred alternative embodiments of the arrangements in FIG. 2.
Figure 4:
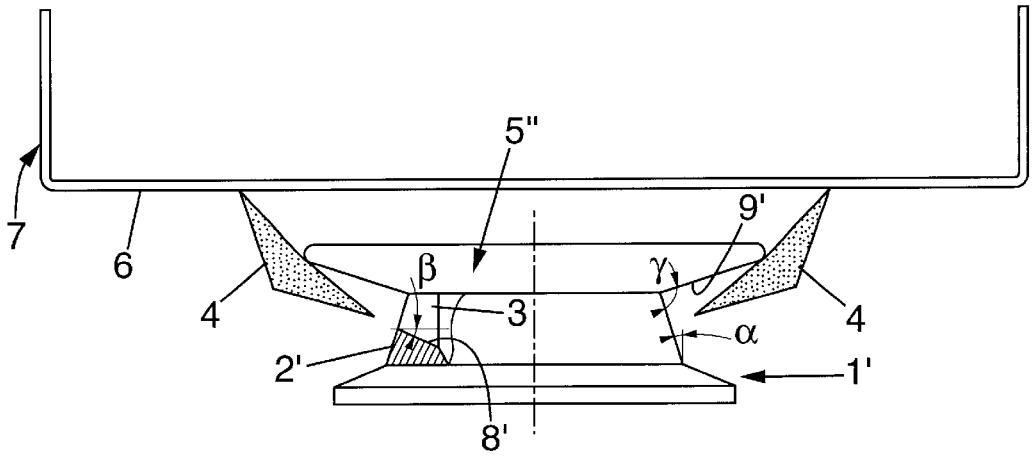

The beneficial results thus obtained may be further improved by making use of one or both of the complementary arrangements illustrated in FIGS. 3 and 4, these relating to a specific arrangement of the cap 5 projecting radially outwards beyond the side wall 2 of the burner head.

In a conventional arrangement of the cap 5, illustrated in FIG. 1, the peripheral annular portion 9 of the lower face of the cap 5 extending radially beyond the side wall 2 of the burner head extends almost horizontally, or at the very least with a minimum angle of inclination to the horizontal, being located approximately in the extension of the top of the flame orifice. Under these conditions, this peripheral annular portion 9 of the lower face of the cap 5 is an impediment preventing the flames 4 from standing up more and contributing (in conjunction with the fact that the side wall 2 has minimal conicity and the bottom 8 of the slots 3 are almost horizontal) to the flames 4 moving away towards the peripheral edge of the bottom 6 of the vessel 7.

The invention proposes to design the underside of the cap so that, in conjunction with the basic arrangements explained above with regard to FIG. 2, the flames 4 can be made to stand up even more appreciably.

A first possible arrangement consists, as illustrated in FIG. 3, in standing off the peripheral annular portion 9 above the flame orifices by a value h, all other things being the same. This stand-off may be between about 2 mm and 6 mm, typically around 3 mm.

In practice, this result may be achieved, as illustrated in FIG. 3, by producing the central part of the lower face of the cap 5' (which is surrounded by the abovementioned peripheral annular portion 9) in the form of a plate 10 protruding vertically downwards. It is via this plate 10 that the cap 5' rests on the top of the burner head 1', the latter being designed in an identical manner to FIG. 2. This stand-off leaves a greater space around the flame orifices, which makes it easier for the flames 4 to stand up more effectively.

A second possible arrangement consists, as illustrated in FIG. 4, in increasing the angle of inclination of the peripheral annular portion 9' with respect to the wall 2'. This angle of inclination $\gamma$ is between about 90° and 110°, and is typically about 100°. Here again, the increased angle of inclination of the peripheral annular portion 9' below the cap 5" contributes to clearing the space around the flame orifices, thereby making it easier for the flames 4 to stand up more effectively.

Of course, it is possible to combine the arrangements of FIGS. 3 and 4.

What is claimed is:

1. A gas burner for a cooker, comprising:

a cap; and a burner head which is bounded by an approximately frustoconical peripheral side wall, the side wall having a top portion and a bottom portion, wherein the top portion has a smaller transverse dimension than the bottom portion, said burner head being topped by the cap, said side wall having a substantial thickness and including a multiplicity of slots distributed peripherally and forming flame orifices, wherein said side wall is inclined to the vertical with an angle of about 10 to 20°, and wherein each slot forming a flame orifice, which extends transversely to said side wall, has a bottom wall inclined to the horizontal with an angle of about 20° to 30°, whereby each flame is guided on said respective bottom wall of said slot so as to leave the respective orifice closer to the vertical.

2. The gas burner according to claim 1, wherein said angle of inclination of said side wall to the vertical is about 15°.

3. The gas burner according to claim 1, wherein said angle of inclination of the bottom of each slot to the horizontal is about 25°.

4. The gas burner according to claim 1, in which the cap projects radially outwards beyond the side wall of the burner head, wherein a peripheral annular portion of a lower face of the cap, which projects radially beyond said side wall of the burner head, is inclined by approximately 90° to 110° with respect said side wall.

5. The gas burner according to claim 4, wherein said annular portion of the lower face of the cap is inclined to the side wall by about 100°.

6. The gas burner according to claim 1, in which the cap projects radially outwards beyond said side wall of the burner head, wherein a peripheral annular portion of a lower face of the cap, which projects radially beyond the side wall of the burner head, has a stand-off of about 2 mm to 6 mm with respect to a bearing surface of the cap on the top of the burner head.

7. The gas burner according to claim 6, wherein the stand-off is about 3 mm.

8. The gas burner according to claim 6, wherein the lower face of the cap includes a plate protruding vertically downwards with respect said annular portion which surrounds the cap, said plate constituting a bearing surface of the cap on the top of the burner head.

* * * * *